US005826809A

United States Patent [19]

Kroger

[11] Patent Number: 5,826,809

[45] Date of Patent: Oct. 27, 1998

[54] SUPPORT FOR CUTTING CYLINDERS IN A PAPER SHREDDER

[75] Inventor: Bruce R. Kroger, West Chicago, Ill.

[73] Assignee: Fellowes Manufacturing Company, Itasca, Ill.

[21] Appl. No.: 847,159

[22] Filed: Apr. 30, 1997

[51] Int. Cl.[6] ..... B02C 4/08

[52] U.S. Cl. ..... 241/167; 241/236; 241/285.1

[58] Field of Search ..... 241/100, 236, 241/285.1, 167, 168

[56] References Cited

U.S. PATENT DOCUMENTS

| | | | |
|---|---|---|---|
| 2,770,302 | 11/1956 | Lee . | |
| 3,033,064 | 5/1962 | Lee . | |
| 3,286,574 | 11/1966 | Durand . | |
| 3,724,766 | 4/1973 | Bosland | 241/100 |
| 3,797,765 | 3/1974 | Samuels | 241/236 |
| 3,991,944 | 11/1976 | Baikoff | 241/36 |
| 4,018,392 | 4/1977 | Wagner | 241/167 |
| 4,172,400 | 10/1979 | Brierley | 83/500 |
| 4,260,115 | 4/1981 | Hatanaka | 241/236 |
| 4,394,983 | 7/1983 | Ulsky | 241/243 |
| 4,489,897 | 12/1984 | Turner et al. | 241/167 |
| 4,562,971 | 1/1986 | Schwelling | 241/236 |
| 4,565,330 | 1/1986 | Katoh | 241/236 |
| 4,657,192 | 4/1987 | Browning | 241/224 |
| 4,688,730 | 8/1987 | Dahle | 241/166 |
| 4,690,340 | 9/1987 | Hatanaka | 241/236 |
| 4,691,871 | 9/1987 | Mochizuki | 241/166 |
| 4,693,428 | 9/1987 | Raterman et al. | 241/167 |
| 4,919,345 | 4/1990 | Burlington et al. | 241/36 |
| 4,997,134 | 3/1991 | MacGregor | 241/3 |
| 5,071,080 | 12/1991 | Herbst et al. | 241/166 |
| 5,230,477 | 7/1993 | Strohmeyer | 241/166 |
| 5,295,633 | 3/1994 | Kimbro et al. | 241/166 |
| 5,328,107 | 7/1994 | Tsai | 241/295 |
| 5,346,144 | 9/1994 | Stangenberg et al. | 241/100 |
| 5,400,978 | 3/1995 | Strohmeyer | 241/166 |
| 5,409,171 | 4/1995 | Stangenberg et al. | 241/167 |
| 5,511,732 | 4/1996 | Kroger et al. | 241/166 |
| 5,516,050 | 5/1996 | Yamamoto et al. | 241/167 |

FOREIGN PATENT DOCUMENTS

| | | |
|---|---|---|
| 0 395 935 A2 | 11/1990 | European Pat. Off. . |
| 3 312 173 A | 10/1984 | Germany . |
| 2 097 717 | 11/1982 | United Kingdom . |

*Primary Examiner*—John M. Husar

*Attorney, Agent, or Firm*—Sean M. Sullivan; Brinks Hofer Gilson & Lione

[57] ABSTRACT

A support integral with a housing for a paper shredder having a plurality of cutting cylinders with cutting shafts. The support has at least one rib extending outward from at least one wall of the housing toward the cutting shafts of the cutting cylinders.

19 Claims, 3 Drawing Sheets

SUPPORT FOR CUTTING CYLINDERS IN A PAPER SHREDDER

BACKGROUND OF THE INVENTION

This invention pertains to the field of shredders. More specifically, the invention relates to a shaft support for cutting cylinders in a paper shredder.

In order to destroy documents to preserve their confidentiality, shredders exist which cut the paper into narrow strips or chips. Typically, the cutting is achieved by a pair of cutting cylinders having a series of circular cutters arranged along the axis of a shaft. The cutters of one shaft are offset so that the cutters pass between the cutters of the other shaft. In addition, the cutters may be either a straight cut type, which produces narrow strips of paper, or a cross cut type, which produces small paper chips.

Generally, it is economically advantageous to make the cutting shaft as small in diameter as possible. It may also be desirable to use a hollow cutting shaft for the cutting cylinder. However, the cutting cylinder experiences a considerable outward force as it attempts to cut paper of increasing thickness. Consequently, as the amount of paper to be shredded increases, a point is eventually reached where the paper bends the cutting cylinders. This results in paper passing through the shredder without being cut, and may also cause damage to the paper shredder. One typical solution to this problem is to increase the diameter and thickness of the cutting shaft or the beam strength of the material comprising the shaft. Unfortunately, this solution increases the cost and weight of the paper shredder. An equally common solution is to decrease the power input. This solution is also undesirable because it decreases the capacity of the shredder.

One solution to the above problem, however, that still provides a large capacity shredder with a relatively small diameter cutting shaft is disclosed in U.S. patent application No. 08/519,409, commonly assigned with the present application now abandoned. This solution provides a support placed in the cutting path of a multi-cylinder paper shredder to prevent the cutting shafts of the cutting cylinders from separating. In particular, the support comprises a base and two arm members that extend upward from the base such that each arm member supports a separate cutting shaft. This solution, however, utilizes a support that is a separate component from the rest of the paper shredder and is positioned in the cutting path of the paper shredder.

Another common solution to the problem of cutting shaft separation involves additional supplemental shafts and a plurality of support beams. The supplemental shafts run parallel to the cutting shafts between two bearing plates that support the ends of the cutting cylinders. The plurality of support beams are positioned between the cutting shafts and their corresponding supplemental shafts to permit the supplemental shafts to support the cutting shafts. This solution, however, requires the use of additional parts that increase the cost, the size, and the weight of the paper shredder.

Accordingly, it is an object of the present invention to provide a solution to the problem of cutting shafts bending and separating under increased paper loads that provides a large capacity shredder with relatively few parts and a small diameter or hollow cutting shaft. In the present invention, a shredder is provided comprising a housing, a pair of cutting cylinders with cutting shafts, and a support integral with the housing. The support has at least one rib extending outward from at least one wall of the housing to prevent the cutting shafts of the cutting cylinders from bending and separating from each other. As a result of this support, the shredder of the present invention is an improvement over prior art shredders that combats the cutting shaft separation problem with a low cost and lightweight shredder having relatively few parts.

It is also another object of the present invention to provide a support for the cutting shafts of cutting cylinders that does not interfere with the cutting path of a shredder. In addition, it is an object of the present invention to provide a support that also functions as a braking device for slowing or stopping the rotation of the cutting shafts and preventing damage to the shredder that can occur when too thick of a packet of material is passed through the shredder.

SUMMARY OF THE INVENTION

The present invention provides a support integral with a housing for a paper shredder having a plurality of cutting cylinders with cutting shafts. The support comprises at least one rib extending outward from at least one wall of the housing toward the cutting shafts of the cutting cylinders.

The present invention also provides a shredder comprising a housing having a top wall, a bottom wall, a first side wall, and a second side wall. The shredder also comprises a pair of cutting cylinders with cutting shafts, and a support having at least one rib extending outward from one of the side walls of the housing toward the cutting shafts of the cutting cylinders.

DETAILED DESCRIPTION OF THE PREFERRED EMBODIMENTS

Figure 1:
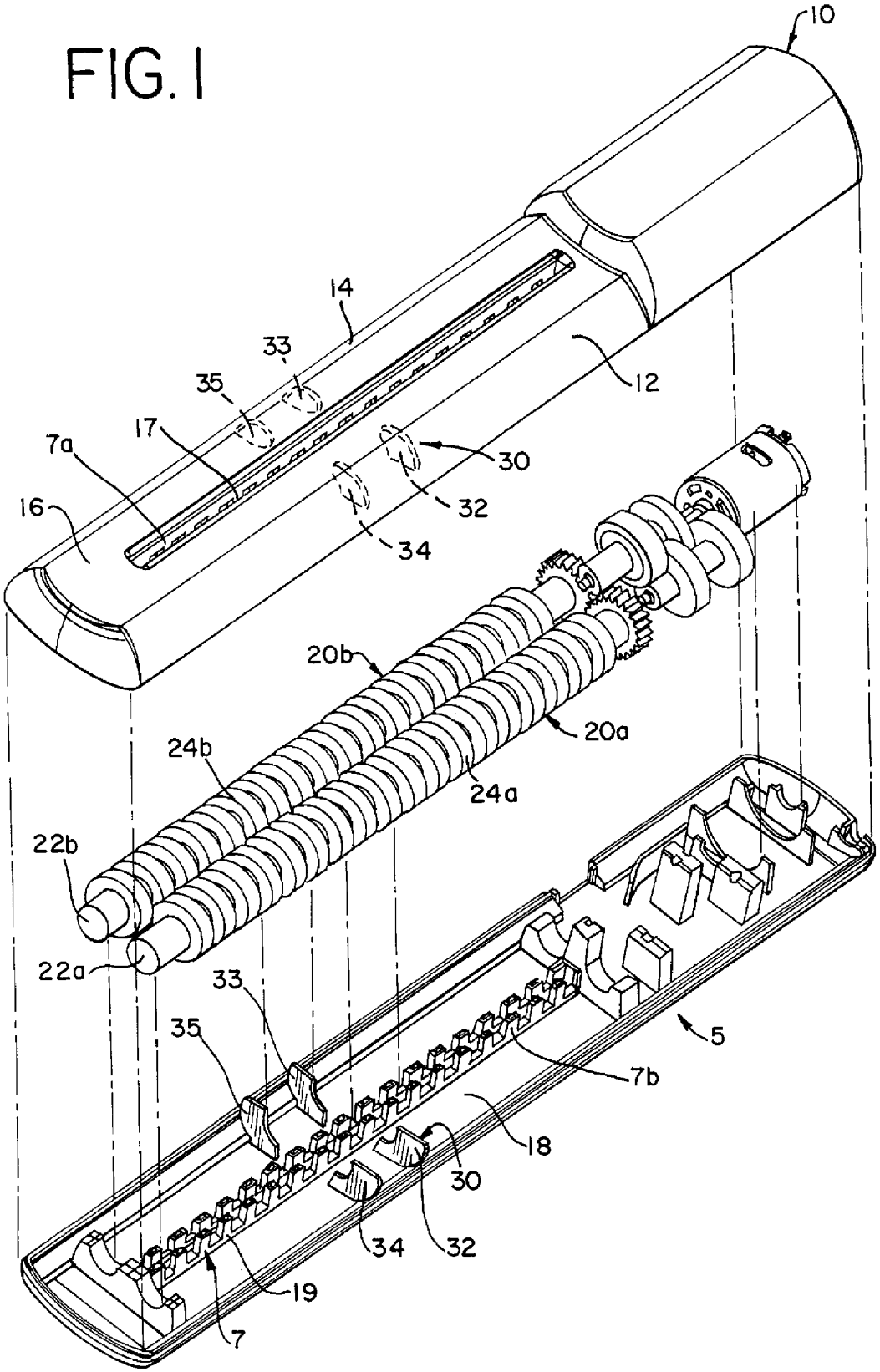
FIG. 1 is an exploded view of a paper shredder with a housing and a support of the present invention.
Figures 2, 3:
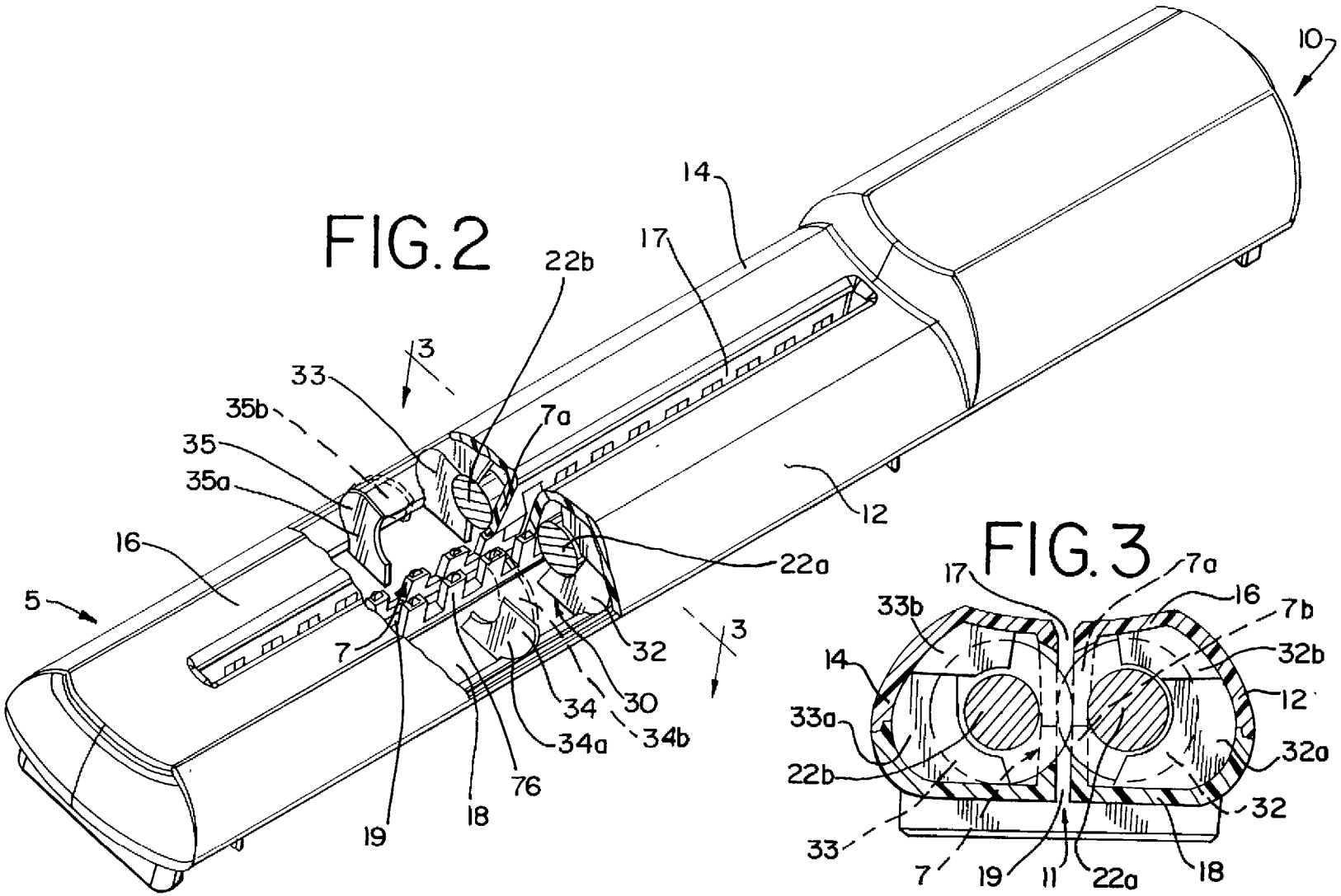
FIG. 2 is a perspective view of the paper shredder of FIG. 1, with a portion of the paper shredder broken away to show the support of FIG. 1.
FIG. 3 is a cross-sectional view of the paper shredder and support of FIG. 2 taken along line 3—3.

Turning now to the drawings, FIGS. 1–2 show a paper shredder 5 comprising a housing 10 with a first side wall 12, a second side wall 14, a top wall 16, and a bottom wall 18. The top wall 16 has a feed opening 17 through which the paper to be shredded is fed, and the bottom wall 18 has a discharge opening 19 through which the shredded paper exits. The paper shredder 5 also has a cutting path 11 that runs between the feed opening 17 and the discharge opening 19, as best shown in FIG. 3.

The paper shredder 5 also comprises a stripper 7 that is positioned along the cutting path 11 between the cutting cylinders 20*a*, 20*b*, as shown in FIGS. 1–3. The stripper 7 may be unitary, or alternatively, may be comprised of one or more upper teeth 7*a* extending downward from the top wall 16, and/or one or more opposing lower teeth 7*b* extending upward from the bottom wall 18. The strippers 7 prevent cut material from winding around the cutting cylinders and clogging the shredder.

As also shown in FIGS. 1–2, the paper shredder also comprises a first cutting cylinder 20*a* and a second cutting cylinder 20*b*. The first cutting cylinder 20*a* has a first cutting shaft 22*a* and a first set of spaced-apart cutter discs 24*a* arranged on the first cutting shaft 22*a*. Similarly, the second cutting cylinder 20*b* has a second cutting shaft 22*b* and and a second set of spaced-apart cutter discs 24*b* arranged on the second cutting shaft 22*b*. In addition, the cutter discs of first cutting cylinder are sufficiently separated from each other to receive the cutter discs of the second cutting cylinder in an interleaving fashion.

The paper shredder 5 also comprises a support 30 integral with the housing 10, as shown in FIGS. 1–2. Providing a support that is integral with the housing of the paper shredder increases the strength of the support and allows the housing to absorb a portion of any force exerted on the support by the cutting cylinders. The support 30 comprises at least one rib which extends outward from at least one wall of the housing toward the cutting shafts of the cutting cylinders. Although the support may include any desirable number of ribs for supporting one or both of the cutting cylinders, the support preferably includes a first rib 32, a second rib 33, a third rib 34, and a fourth rib 35. The first and third ribs 32, 34 are positioned between the cutter discs 24*a* arranged on the cutting shaft 22*a* of the cutting cylinders 20*a*. The second and fourth ribs 33, 35 are positioned between the cutter discs 24*b* arranged on the cutting shaft 22*b* of the cutting cylinders 20*b*. Preferably, the second and fourth ribs 33, 35 are offset from being aligned in the same plane with the first and second ribs 32, 34, respectively, by only a cutter disc, as shown in FIGS. 1–2. In addition, apart from being spaced from one another, the first and third ribs are preferably, but not necessarily, identical to each other, and the second and fourth ribs are preferably, but not necessarily, identical to each other.

As shown in FIGS. 3–7, the ribs may extend from one or more of the walls of the housing 10. Preferably, the first and third ribs 32, 34 extend outward from the first side wall 12, the top wall 16, and the bottom wall 18 toward the first cutting shaft 22*a*, and the second and fourth ribs 33, 35 extend outward from the second side wall 14, the top wall 16, and the bottom wall 18 toward the second cutting shaft 22*b*, as shown in FIGS. 2–3. Each of the ribs 32, 33, 34, 35 may also be divided into a first portion 32*a*, 33*a*, 34*a*, 35*a* and a separate second portion 32*b*, 33*b*, 34*b*, 35*b*, respectively, for manufacturing purposes. During assembly of the paper shredder of the present invention, the first portion 32*a*, 33*a*, 34*a*, 35*a* of each rib may then be joined together with the corresponding second portion 32*b*, 33*b*, 34*b*, 35*b* of each rib to form the first, second, third, and fourth ribs 32, 33, 34, 35, respectively. The first and second portions of the ribs may be joined by any desirable method such as welding, gluing, bonding, snap-fitting or the like.

Figure 4:
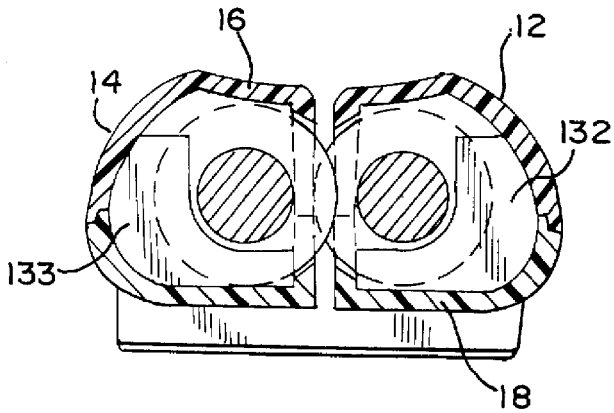
FIG. 4 is a cross-sectional view of the paper shredder of FIG. 2 taken along line 3—3, with another embodiment of the support of the present invention.
Figure 5:
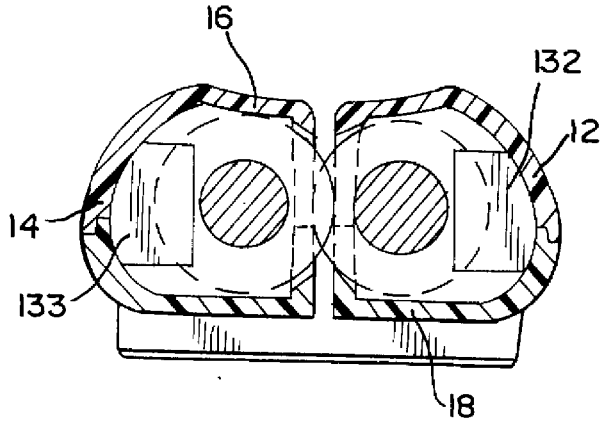
FIG. 5 is a cross-sectional view of the paper shredder of FIG. 2 taken along line 3—3, with another embodiment of the support of the present invention.
Figure 6:
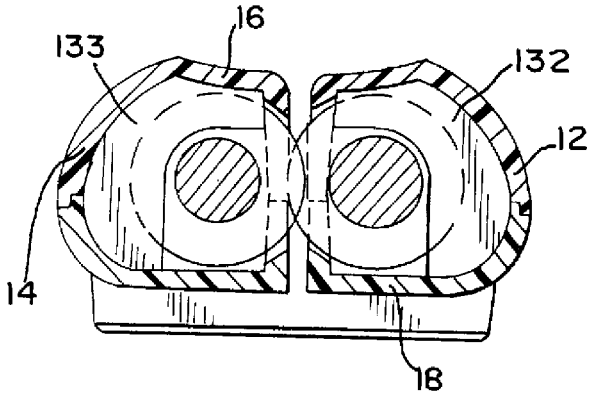
FIG. 6 is a cross-sectional view of the paper shredder of FIG. 2 taken along line 3—3, with another embodiment of the support of the present invention.
Figure 7:
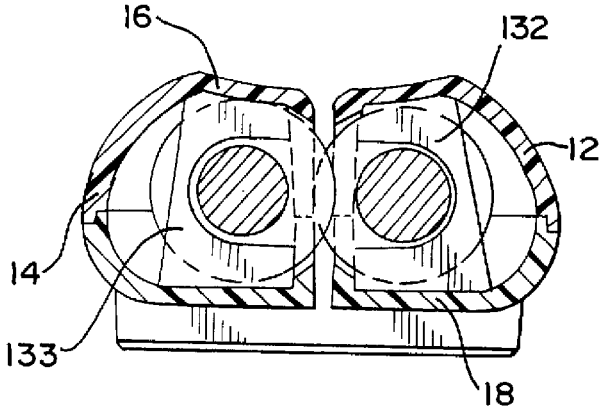
FIG. 7 is a cross-sectional view of the paper shredder of FIG. 2 taken along line 3—3, with another embodiment of the support of the present invention.

As shown in FIGS. 4–7, it is conceivable that the ribs may have any number of different configurations. The ribs shown in these figures are preferably, but not necessarily, identical to the ribs shown in FIGS. 1–3, with the exception that the ribs shown in FIGS. 4–7 have slightly different configurations. Accordingly, in order to avoid unnecessary redundancy, only the different configurations of the ribs in FIGS. 4–7 will be discussed. In addition, only the first and second ribs are shown in FIGS. 4–7, since the third and fourth ribs are identical to the first and second ribs, respectively. Also, the reference numerals used for the ribs shown in FIGS. 4–7 correspond to the reference numerals used for the ribs shown in FIGS. 1–3. The reference numerals used in FIGS. 4–7, however, place a 1, 2, 3, or 4 in front of the corresponding reference numeral used for the ribs in FIGS. 1–3. For example, the ribs identified by reference numerals 132, 133, 134, and 135 in FIG. 4, are similar to the ribs identified by reference numerals 32, 33, 34, and 35 in FIGS. 1–3.

For the ribs shown in FIG. 4, the first and third ribs 132, 134 extend outward from the first side wall and the bottom wall of the housing toward the first cutting shaft, and the second and fourth ribs 133, 135 extend outward from the second side wall and the bottom wall of the housing toward the second cutting shaft. For the ribs shown in FIG. 5, however, the first and third ribs 232, 234 extend outward from only the first side wall, and the second and fourth ribs 233, 235 extend outward from only the second side wall. Alternatively, in FIG. 6, the first and third ribs 332, 334 extend outward from the first side wall and the top wall toward the first cutting shaft, and the second and fourth ribs 333, 335 extend outward from the second side wall and the top wall toward the second cutting shaft. Finally, in FIG. 7, the first and third ribs 432, 434 extend outward from the bottom wall and the top wall toward the first cutting shaft, and the second and fourth ribs 433, 435 extend outward from the bottom wall and the top wall toward the second cutting shaft. Similar to the ribs shown in FIGS. 1–3, each of the ribs in FIGS. 4–7 may be divided into a first portion and a separate second portion for manufacturing purposes. During assembly of the paper shredder implementing one of the rib configurations shown in FIGS. 4–7, the first portion of each rib may then be joined together with the corresponding second portion of each rib to form the first, second, third, and fourth ribs. The first and second portions of the ribs may be joined by any desirable method such as welding, gluing, bonding, snapfitting or the like.

Although the ribs may have any desirable thickness, they preferably have a thickness less than the space between each pair of cutter discs, as shown in FIGS. 1–2. Alternatively, the ribs may have a thickness approximately equal to the space between each pair of cutter discs. For manufacturing reasons, these thicker ribs may also have a hollow center (not shown). Preferably, there is also a slight clearance gap 28 between the rib or ribs of the support and the cutting shafts of the cutting cylinders, as best shown in FIGS. 3–7, to allow the cutting shafts to freely rotate during normal operation of the paper shredder.

The support of the present invention functions in the following manner during operation of the paper shredder. As a thick load of paper is introduced into the feed opening and the cutting path of the paper shredder, the load of paper begins to bend and flex the cutting cylinders and their cutting shafts outwardly away from each other. As a result, the cutting shafts of the cutting cylinders make contact with the ribs of the support. At this point, the support, and thus the housing of the paper shredder (since the housing is integral with the support), absorbs some of outward force exerted by the bent cutting shafts. The ribs of the support then exert an opposing force against the cutting shafts to limit the bending of the shaft and prevent the cutting cylinders from separating. Since the ribs of the support prevent the cutting cylinders from separating, all of the paper passing through the cutting path of the paper shredder is cut.

In addition, when a paper shredder is overloaded with paper in excess of the paper shredder's capacity, the support of the present invention also provides a braking function for the cutting cylinders. Specifically, as the cutting shafts of the cutting cylinders bend further outward away from each other and press against the ribs of the support with a greater force due to the excess load of paper, the ribs act as brakes that slow or even stop (depending on the amount of excess paper) the rotation of the cutting shafts. As a result, the ribs of the support prevent damage that can occur to the cutting cylinders and the paper shredder when too thick of a load of paper is passed through the cutting path of the paper shredder.

The support of the present invention may be used in a variety of different paper shredding machines. Examples of paper shredders suitable for use with the support of the present invention are disclosed in U.S. Pat. Nos. 5,071,080 and 5,511,732, both commonly assigned with the present application and specifically incorporated herein by reference.

In operation, the present invention can be used with particular advantage in a paper shredder for the office or the home. Since the support of the present invention is integral with the housing, there are no additional parts in a paper shredder that utilizes the support of the present invention. Accordingly, such paper shredders are relatively inexpensive.

It should be understood that a wide range of changes and modifications can be made to the embodiments of the support and paper shredder described above. For instance, the side walls of the housing may or may not be the outermost wall of the housing. It is therefore intended that the foregoing description illustrates rather than limits this invention, and that it is the following claims, including all equivalents, which define this invention.

What is claimed is:

1. In a paper shredder having a housing, a first cutting cylinder with a first cutting shaft, a second cutting cylinder with a second cutting shaft, and a stripper positioned along a cutting path between the cutting cylinders, the improvement comprising a support integral with the housing, the support comprising:

a first rib extending outward from at least one of a bottom wall and a top wall of the housing toward the first cutting shaft of the first cutting cylinder; and a second rib extending outward from at least one of a bottom wall and a top wall of the housing toward the second cutting shaft of the second cutting cylinder.

2. A shredder comprising:

a housing having a top wall, a bottom wall, a first side wall, and a second side wall;

a first cutting cylinder having a first cutting shaft;

a second cutting cylinder having a second cutting shaft; and a support integral with the housing, the support having a first rib extending outward from at least one of the bottom wall and the top wall of the housing toward the first cutting shaft and a second rib extending outward from at least one of the bottom wall and the top wall of the housing toward the second cutting shaft.

3. The shredder of claim 2 wherein the first rib extends both above and below a horizontal line through a center of the first cutting shaft, and the second rib extends both above and below a horizontal line through a center of the second cutting shaft.

4. The shredder of claim 2 wherein the first and second ribs extend outward from the top wall and the bottom wall of the housing.

5. The shredder of claim 2 wherein the first rib also extends outward from the first side wall of the housing toward the first cutting shaft and the second rib also extends outward from the second side wall of the housing toward the second cutting shaft.

6. The shredder of claim 2 wherein the first and second ribs extend outward from the top wall of the housing.

7. The shredder of claim 2 wherein the first and second ribs extend outward from the bottom wall of the housing.

8. The shredder of claim 2 further comprising a stripper positioned along a cutting path between the first and second cutting cylinders.

9. The shredder of claim 2 further comprising a first set of spaced-apart cutter discs arranged on the first cutting shaft and a second set of spaced-apart cutter discs arranged on the second cutting shaft, and wherein the first rib is positioned between two adjacent cutter discs arranged on the first cutting shaft and the second rib is positioned between two adjacent cutter discs arranged on the second cutting shaft.

10. A shredder comprising:

a housing having a top wall, a bottom wall, a first side wall, and a second side wall;

a first cutting cylinder having a first cutting shaft;

a second cutting cylinder having a second cutting shaft;

a stripper positioned along a cutting path between the first and second cutting cylinders; and a support integral with the housing, the support having a first rib extending outward from at least one wall of the housing toward the first cutting shaft and a second rib extending outward from at least one wall of the housing toward the second cutting shaft.

11. The shredder of claim 10 wherein the first rib extends outward from the first side wall of the housing toward the first cutting shaft and the second rib extends outward from the second side wall of the housing toward the second cutting shaft.

12. The shredder of claim 11 wherein the first and second ribs also extend outward from the bottom wall of the housing.

13. The shredder of claim 11 wherein the first and second ribs also extend outward from the top wall of the housing.

14. The shredder of claim 12 wherein the first and second ribs also extend outward from the top wall of the housing.

15. The shredder of claim 10 wherein the first and second ribs extend outward from the top wall and the bottom wall of the housing.

16. The shredder of claim 10 wherein the first and second ribs extend outward from the top wall of the housing.

17. The shredder of claim 10 wherein the first and second ribs extend outward from the bottom wall of the housing.

18. The shredder of claim 10 further comprising a first set of spaced-apart cutter discs arranged on the first cutting shaft and a second set of spaced-apart cutter discs arranged on the second cutting shaft, and wherein the first rib is positioned between two adjacent cutter discs arranged on the first cutting shaft and the second rib is positioned between two adjacent cutter discs arranged on the second cutting shaft.

19. The shredder of claim 10 wherein the first rib extends both above and below a horizontal line through a center of the first cutting shaft, and the second rib extends both above and below a horizontal line through a center of the second cutting shaft.

* * * * *